US010807405B2

(12) United States Patent
Michenaud et al.

(10) Patent No.: US 10,807,405 B2
(45) Date of Patent: Oct. 20, 2020

(54) HAND-HELD DEVICE, IN PARTICULAR A WRITING INSTRUMENT, PROVIDED WITH A BLOCKING DEVICE

(71) Applicant: SOCIETE BIC, Clichy (FR)

(72) Inventors: Etienne Michenaud, Paris (FR); Samuel Malinverni, Paris (FR); Arnaud Bez, Garches (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/317,344

(22) PCT Filed: Jul. 5, 2017

(86) PCT No.: PCT/FR2017/051833
§ 371 (c)(1),
(2) Date: Jan. 11, 2019

(87) PCT Pub. No.: WO2018/011488
PCT Pub. Date: Jan. 18, 2018

(65) Prior Publication Data

US 2019/0291501 A1 Sep. 26, 2019

(30) Foreign Application Priority Data

Jul. 12, 2016 (FR) ..... 16 56658

(51) Int. Cl.
*B43L 19/00* (2006.01)
*B43K 24/03* (2006.01)
(Continued)

(52) U.S. Cl.
CPC ..... *B43K 24/03* (2013.01); *B43K 24/02* (2013.01); *B43K 29/00* (2013.01); *B43L 19/0075* (2013.01)

(58) Field of Classification Search
CPC ..... B43K 24/03; B43K 24/10; B43K 29/00; B43K 29/02; B43K 29/18; B43K 27/00;
(Continued)

(56) References Cited

U.S. PATENT DOCUMENTS 501,850 A 7/1893 Stuart
2,587,935 A 3/1952 Wallace
(Continued)

FOREIGN PATENT DOCUMENTS

FR 1100962 9/1955
GB 771521 4/1957
(Continued)

OTHER PUBLICATIONS

International Search Report dated Oct. 5, 2017 from corresponding International PCT Patent Application No. PCT/FR2017/051833, 3 pages.

*Primary Examiner* — David J Walczak
(74) *Attorney, Agent, or Firm* — Ohlandt, Greeley, Ruggiero & Perle, L.L.P.

(57) ABSTRACT

A hand-held device includes a first portion and a second portion. The first portion is engaged at least in part with the second portion while being movable in translation in an axial direction relative to the second portion. The first portion presents a first distal end while the second portion presents a second distal end opposite from the first distal end in the axial direction. A blocking device is configured to prevent the first portion from moving in translation in the axial direction relative to the second portion only when, considered in the gravity direction, the first distal end is arranged above the second distal end. The blocking device includes a chamber and a ball or the equivalent housed in the chamber.

8 Claims, 2 Drawing Sheets

(51) Int. Cl.
*B43K 24/02* (2006.01)
*B43K 29/00* (2006.01)

(58) Field of Classification Search
CPC ..... B43K 24/02; B43K 24/04; B43K 24/08; B43L 19/0075; B43L 19/0081; B43M 11/06; B43M 11/08; A45D 40/20
See application file for complete search history.

(56) References Cited

U.S. PATENT DOCUMENTS

| | | | | |
|---|---|---|---|---|
| 2,605,746 | A | 8/1952 | Kahn et al. | |
| 2,693,170 | A | 11/1954 | Sears | |
| 2,757,639 | A | 8/1956 | Wichmann | |
| 7,296,942 | B2 * | 11/2007 | Mayne ..... | B43K 24/04 401/115 |

FOREIGN PATENT DOCUMENTS

| | | |
|---|---|---|
| GB | 2381243 | 4/2003 |
| JP | 2015-20282 | 2/2015 |

* cited by examiner

HAND-HELD DEVICE, IN PARTICULAR A WRITING INSTRUMENT, PROVIDED WITH A BLOCKING DEVICE

CROSS-REFERENCE TO RELATED APPLICATIONS

The present Application is a National Phase Entry of international Application No. PCT/FR2017/051833, filed Jul. 5, 2017 that claims priority to French Application No. 1656658 filed on Jul. 12, 2016, the entire contents of each of which is incorporated by reference herein.

FIELD OF THE INVENTION

The invention relates to a hand-held device fitted with a blocking device for preventing one portion from moving in translation relative to another portion as a function of the relative positions of those two portions considered in the gravity direction. The invention relates particularly, but not necessarily, to writing instruments.

BACKGROUND

Hand-held devices are known presenting a first portion that is movable relative to a second portion, such as for example the rear portion carrying a mechanical pencil eraser that is movable relative to the front portion of the mechanical pencil. However, when it is sought to use the second portion, e.g. when it is sought to use the eraser, the second portion remains movable relative to the first portion, which may lead the user to move the second portion relative to the first portion inadvertently, thus causing, for example, the lead of the mechanical pencil to be extended even though the eraser is being used. Such operation is generally not desirable. There therefore exists a need in this sense.

SUMMARY OF THE INVENTION

An embodiment provides a hand-held device comprising a first portion and a second portion, the first portion being engaged at least in part with the second portion while being movable in translation in an axial direction relative to the second portion (and vice versa), the first portion presenting a first distal end while the second portion presents a second distal end opposite from the first distal end in the axial direction, and a blocking device configured to prevent the first portion from moving in translation in the axial direction relative to the second portion (and vice versa) only when, considered in the gravity direction, the first distal end is arranged below the second distal end, the blocking device comprising a chamber and a ball or the equivalent housed in the chamber.

Naturally, all or part of the first portion may be engaged in the second portion or, vice versa, all or part of the second portion is engaged in the first portion. By way of example, the direction of engagement of the first portion with the second portion corresponds to the axial direction. Naturally, each part may be formed by a single part, or by a plurality of parts assembled together. Below and unless specified to the contrary, terms involving movement (e.g. movement in translation or sliding) of the first portion "relative" to the second portion naturally refers to "relative" movement of the first and second portions regardless of which portion(s) might be considered to be moving.

The term "gravity direction" naturally refers to the direction of newtonian gravitational acceleration created by the Earth or, more generally by the body or celestial body on which the hand-held device is used.

The term "ball or the equivalent" refers to any solid element of any shape, that is movable in the chamber, and that is suitable for being moved in the chamber under the effect of gravity relative to the walls defining the cavity of the chamber. Below, and unless specified to the contrary, the term "ball", refers to a "ball or the equivalent". Naturally, the chamber may be of any shape, which may be simple or complex.

Thus, with reference to the gravity direction, as a result of the ball moving in the chamber, when the first distal end is below the second distal end, the blocking device authorizes the movement in translation in the axial direction of the first portion relative to the second portion while the first distal end is above the second distal end, the blocking device blocks movement in translation in the axial direction of the first portion relative to the second portion. Below, and unless specified to the contrary, the relative position "above" or "below" the first and second distal ends is considered in the gravity direction.

It should therefore be understood that the blocking device is a device that blocks by gravity. Thus, in the first state in which the first distal end is arranged above the second distal end, considered in the gravity direction, the blocking device prevents movement in translation in the axial direction of the first portion relative to the second portion automatically and only by means of the effects of gravity, whereas in a second state in which the first distal end is arranged below the second distal end, considered in the gravity direction, the blocking device allows movement in translation in the axial direction of the first portion relative to the second portion automatically and only by means of the effects of gravity.

Consequently, the hand-held device presents a first configuration in which the first portion may be moved in the axial direction relative to the second portion, for example, but not necessarily, in order to actuate any mechanism, e.g. a mechanism for retracting/extending a head into/out from a distal end selected from the first distal end and the second distal end, this first configuration corresponding to the configuration in which the first distal end is below the second distal end. The hand-held device also presents a second configuration in which the first portion cannot be moved in the axial direction relative to the second portion by means of the blocking device, e.g. but not necessarily, in order to block said mechanism for retracting/extending the head, this configuration corresponding to the configuration in which the first distal end is above the second distal end. Naturally, blocking performed by the blocking device may be strict blocking without any axial clearance between the first and second portions, or blocking with some axial clearance between the first portion and the second portion, or indeed a limitation of the relative axial stroke between the first portion and the second portion (i.e. blocking with relatively large clearance).

Naturally, it should be understood that in the second configuration, the ball of the blocking device cooperates with the first portion and the second portion in such a manner as to block their relative movement in translation in the axial direction, whereas in the first configuration the ball does not cooperate with the first portion and the second portion in such a manner as to block their relative movement in translation in the axial direction. Thus, in the first configuration, the ball is in a "free" position (i.e. a position in which the blocking device leaves the first portion free to move in axial translation relative to the second portion) whereas in the second configuration, the ball is in a "blocking" position (i.e. a position in which the blocking device blocks the first portion in axial translation relative to the second portion).

It should be observed that by means of the structure of the blocking device, i.e. by means of the ball, and in particular the ball housed in a chamber, blocking is performed in the second configuration independently of how any other element/mechanism of the hand-held device might be configured. Thus, by way of example, if the hand-held device presents a mechanism for extending/retracting a head out from/into a distal end selected from the first and second distal ends, the blocking device prevents the first portion from moving in translation relative to the second portion regardless of the position of said head, i.e. whether the head is in the retracted position or in the extended position (naturally, only when the first distal end is above the second distal end).

By way of example, the head is formed by any hand-held device tool endpiece, e.g. the endpiece of a wrench, a screwdriver, a blade, a punch, a writing body (felt tip, ballpoint tip, or other tip, graphite pencil lead, chalk, or any other means making it possible to write on a substrate), a brush, an eraser, a friction body, a pad for a capacitive screen, a cosmetic applicator (makeup brush, pencil, mascara brush, roll-on applicator, lipstick, or any other means for applying cosmetics), etc.

Thus, by means of the blocking device, it is possible to avoid handling/activating (e.g. retracting/extending) a first head of the hand-held device when a second head is used that is opposite from the first head in the axial direction of the hand-held device (the first head naturally being activated by a relative movement in translation in the axial direction of a first portion relative to a second portion). In addition, the structure of the blocking device presents the advantage of being compact, which increases the general compactness of the hand-held device, whereby the hand-held device may have dimensions that are adaptable to the hands of the majority of users.

In some embodiments, the minimum distance between two walls defining a cavity of the chamber lies in the range 102% to 125% of the diameter of the ball (or of the greatest dimension of the ball when the "ball or the equivalent" is not spherical).

It should be understood that the walls define a cavity configured to receive the ball, the walls being suitable for forming part of a single element, but not necessarily. By way of example, the walls form part of two respective distinct elements and, when they are arranged facing each other, they define a cavity receiving the ball, said cavity forming at least a portion of the enclosure of the chamber. Such a configuration makes it possible to ensure the ball moves freely within the chamber, while making the blocking device more compact.

In some embodiments, the chamber is formed between two walls respectively forming parts of the first portion and of the second portion.

By way of example, a first wall of the first portion forms a concave shape and/or a second wall of the second portion facing the first portion in at least one predetermined relative position (e.g. in the first configuration). Thus, the chamber comprises this or these concave shape(s), all or part of the ball being housed in this or these concave shape(s).

Such a chamber structure has a compact structure, while enabling the ball to cooperate directly with the first portion and with the second portion.

In some embodiments, a wall defining the volume of the chamber presents a receptacle configured to receive all or part of the ball when the first distal end is arranged above the second distal end, considered in the gravity direction.

It should be understood that the receptacle is a portion of a wall of the chamber in which all or part of the ball is housed when the first distal end is above the second distal end. Thus, in the second configuration of the hand-held device, i.e. when the ball is in the blocking position, the receptacle holds the ball in position, whereby the blocking position of the ball is more stable and the blocking performed by the blocking device is more reliable.

In some embodiments, the receptacle is formed by a passage extending in the axial direction from the chamber, said passage presenting a width that is smaller than the diameter of the ball or the equivalent.

By way of example, the width of the passage lies in the range 50% to 90% of the diameter of the ball (or of the smallest dimension of the "ball or the equivalent" when said ball or the equivalent is not spherical). Naturally, in a variant, the passage presents a portion that is larger than the ball and that leads directly to a narrower portion, this narrower portion presenting a width that is smaller than the diameter of the ball. By way of example, the passage is formed by an axial groove.

By way of example, such a configuration makes it possible to combine two separate functions for a single element, for example the passage being able to serve both to guide an element and also to form a receptacle. By way of example, such a configuration makes it possible to block a sliding element in the passage.

In some embodiments, the blocking device comprises an abutment configured to cooperate with the ball when the first distal end is arranged above the second distal end, considered in the gravity direction.

It should be understood that a space is formed between the abutment and a wall of the chamber, while the ball is arranged in this space between the abutment and the wall when the first distal end is arranged above the second distal end. Such a structure is simple and compact, whereby the blocking device is robust and has little or no effect on the general compactness of the hand-held device.

In some embodiments, the receptacle is made in a wall forming part of a portion selected from the first portion and the second portion, whereas the abutment is secured to the other portion from among the first portion and the second portion.

Such a structure is particularly simple and compact, whereby the blocking device is robust and has little or no effect on the general compactness of the hand-held device.

By way of example, the receptacle is arranged facing the abutment in the axial direction. Thus, when the first distal end is above the second distal end, the ball enters the blocking position very easily and remains held in the blocking position by means of the receptacle, while being arranged facing the abutment in the axial direction, which makes it possible to reduce clearances as much as possible in the axial direction between the first portion and the second portion.

In some embodiments, the abutment is configured to engage at least in part in the passage during the movement in translation of the first portion relative to the second portion.

It should therefore be understood that when the first distal end is below the second distal end, i.e. when the first portion can slide in the axial direction relative to the second portion, the abutment and the passage are configured to cooperate in sliding, the abutment engaging in the passage. In this configuration, the passage makes it possible to guide relative movements between the first portion and the second portion. When the first distal end is above the second distal end, then the ball is received by the receptacle formed at the inlet to the passage, thus blocking access of the abutment to the passage, whereby the relative sliding between the first portion and the second portion is blocked. By way of example, in the rest position, i.e. when the first and second portions are not moved relative to each other in the axial direction by the user, the axial space between the abutment and the inlet of the passage lies in the range 105% to 110% of the diameter of the ball (or of the largest dimension of the ball when the "ball or the equivalent" is not spherical).

In some embodiments, the ball or the equivalent is metallic.

A metal ball presents a certain amount of inertia, which improves its retention in the blocking position.

In some embodiments, the hand-held device forms a writing instrument extending in the axial direction.

It should therefore be understood that the first distal end and/or the second distal end is fitted with a writing tip, e.g. a retractable tip or a stationary tip, e.g. a mechanical pencil lead, a graphite lead, a ballpoint tip, a felt tip, etc.

Such a hand-held device fitted with the ball blocking device is particularly well adapted to writing instruments.

In some embodiments, the first distal end is fitted with a writing tip, whereas the second distal end is fitted with an eraser, a friction body, or a pad for a capacitive screen.

It should be understood that the friction body is a body configured to be rubbed over a surface, for example in order to generate heat and to cause a thermochromic ink to change color, i.e. an ink that changes color as a function of the heat to which it is subjected.

It should be understood that a pad for a capacitive screen is a termination configured to interact with a capacitive screen. The pad is conductive (because of the material from which it is made, or because of a coating). There is no limitation on the shape, the flexibility/stiffness, and the material(s) of a pad, providing the pad is capable of interacting with a capacitive screen, i.e. providing the screen can detect it making contact therewith.

The hand-held device fitted with the ball blocking device is particularly well adapted to writing instruments having such combinations of heads.

BRIEF DESCRIPTION OF THE DRAWINGS

The invention and its advantages can be better understood on reading the detailed description of various embodiments of the invention given as non-limiting examples. The description refers to the accompanying sheets of figures, in which.

DETAILED DESCRIPTION OF EMBODIMENTS

Figure 1:
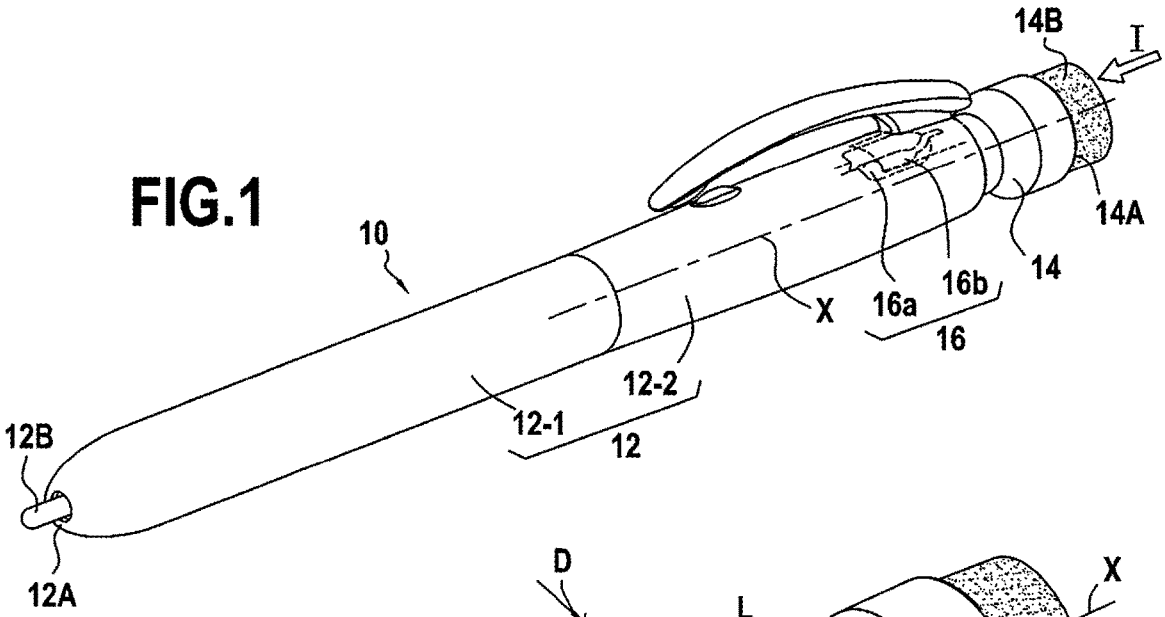
FIG. 1 shows a hand-held device seen in perspective.

FIG. 1 shows a hand-held device 10, in this embodiment a writing instrument, and more particularly a mechanical pencil, comprising a first portion 12 and a second portion 14 engaged in the first portion 12 while being movable in translation in an axial direction X. In this example, the relative sliding direction X between the first and second portions 12 and 14 corresponds to the direction in which the hand-held device 10 extends.

The first portion 12 presents a first distal end 12A fitted with a first head 12B, and presenting an orifice for passing the first head 12B. In this example, the first head 12B is a writing tip, and more particularly a graphite pencil lead that can retract into/extend out from the first portion 12A. In FIG. 1, the first head 12B is extended and projects from the first distal end 12A. In this example, the first portion 12 is formed by two parts 12-1 and 12-2 mounted with each other by screw-fastening (not shown). Naturally, in a variant, the two parts 12-1 and 12-2 could form one and the same part, or the first portion 12 could comprise more than two parts. The first portion 12 houses a lead-propelling mechanism (not shown) for propelling the lead 12B when the first portion 12 is moved relative to the second portion 14 (or vice versa), in addition such a mechanism being known.

The second portion 14 presents a second distal end 14A fitted with a second head 14B, in this example an eraser. In addition, in known manner, by pressing on the eraser 14B in the direction of arrow I shown in FIG. 1, the first portion 12 is moved in translation relative to the second portion 14 in the axial direction X, whereby the lead-propelling mechanism is activated and the lead 12B is caused to move forwards from the first distal end 12A.

A blocking device 16 is shown in dashed lines in FIG. 1, the device naturally being located inside the hand-held device 10 and therefore usually not being visible. The blocking device 16 comprises a metal ball 16A and a chamber 16B receiving the ball 16A. An abutment 12D of the blocking device 16, described above with reference to FIG. 3, is not shown in FIG. 1 for reasons of clarity.

Figure 2:
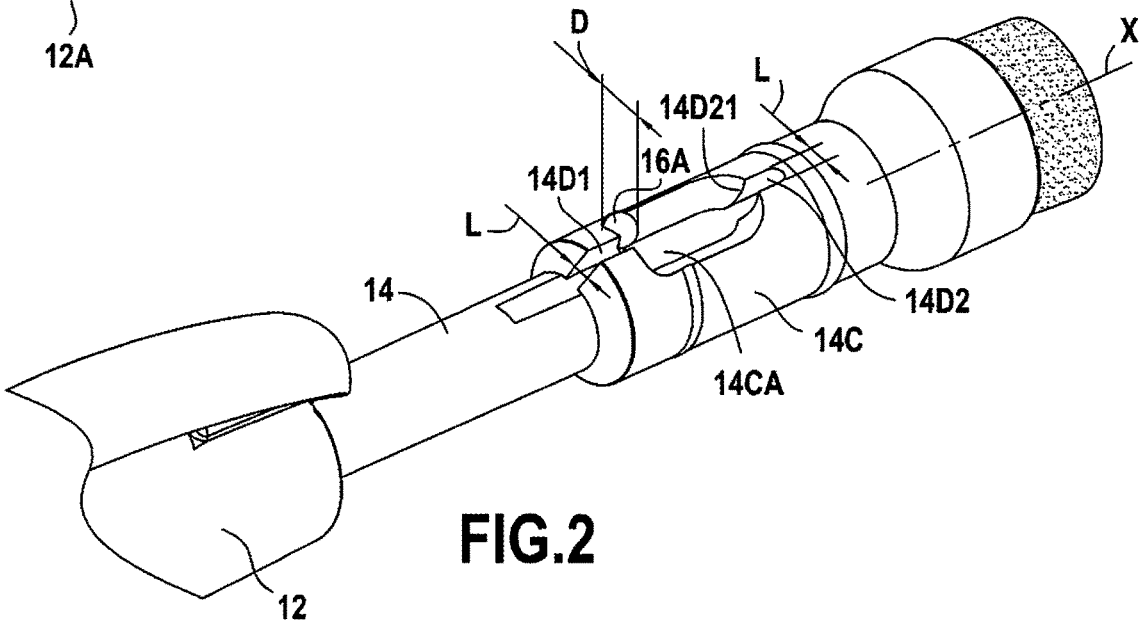
FIG. 2 shows the first and second portions of the FIG. 1 hand-held device, in an exploded view.
Figure 3:
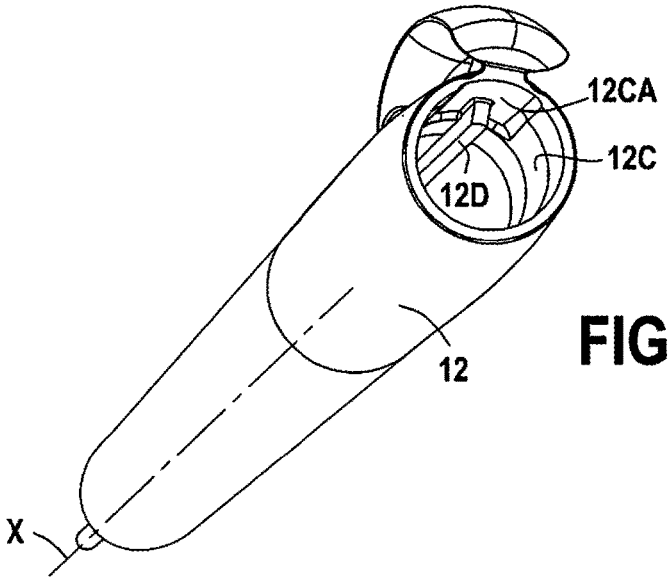
FIG. 3 is a detail view of the inside of the first portion.

The blocking device 16 is described below in greater detail with reference to FIGS. 2 and 3.

The chamber 16B is formed between two facing walls 12C and 14C forming parts of the first and second portions 12, 14 respectively. More particularly, in this example, the wall 12C is an inside wall of the first portion 12, whereas the wall 14C is an outside wall of the second portion 14. Each of these walls 12C and 14C has a concave shape 12CA and 14CA. These two concave shapes 12CA and 14CA form the chamber 16B.

The first portion 12 presents an abutment 12D formed by an axial spline. The second portion 14 presents a first passage 14D1 and a second passage 14D2, each of the passages being formed by an axial groove. The abutment 12D is configured to engage itself at least in part in the passages 14D1 and 14D2, and to slide in the passages.

Each of the first and second passages 14D1 and 14D2 leads into the concave shape 14CA (or more generally into the chamber 16B), and they are disposed facing each other, on either side of the concave shape 14CA (or more generally of the chamber 16B) in the axial direction X. It should be observed that the passages 14D1 and 14D2 each present an identical, constant width L that is smaller than the diameter D of the ball 16A. In this example, the width L is equal to 60% of the diameter D.

Figure 4:
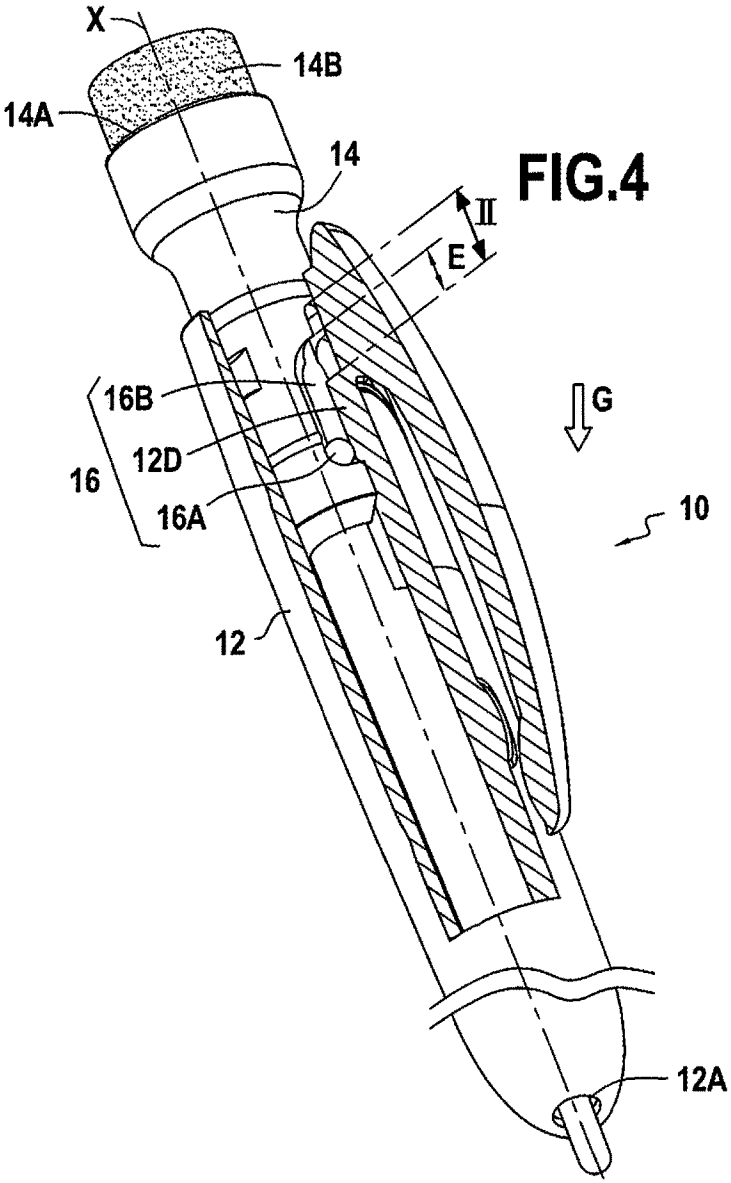
FIG. 4 is a cut-away view in which the first distal end is below the second distal end.
Figure 5:
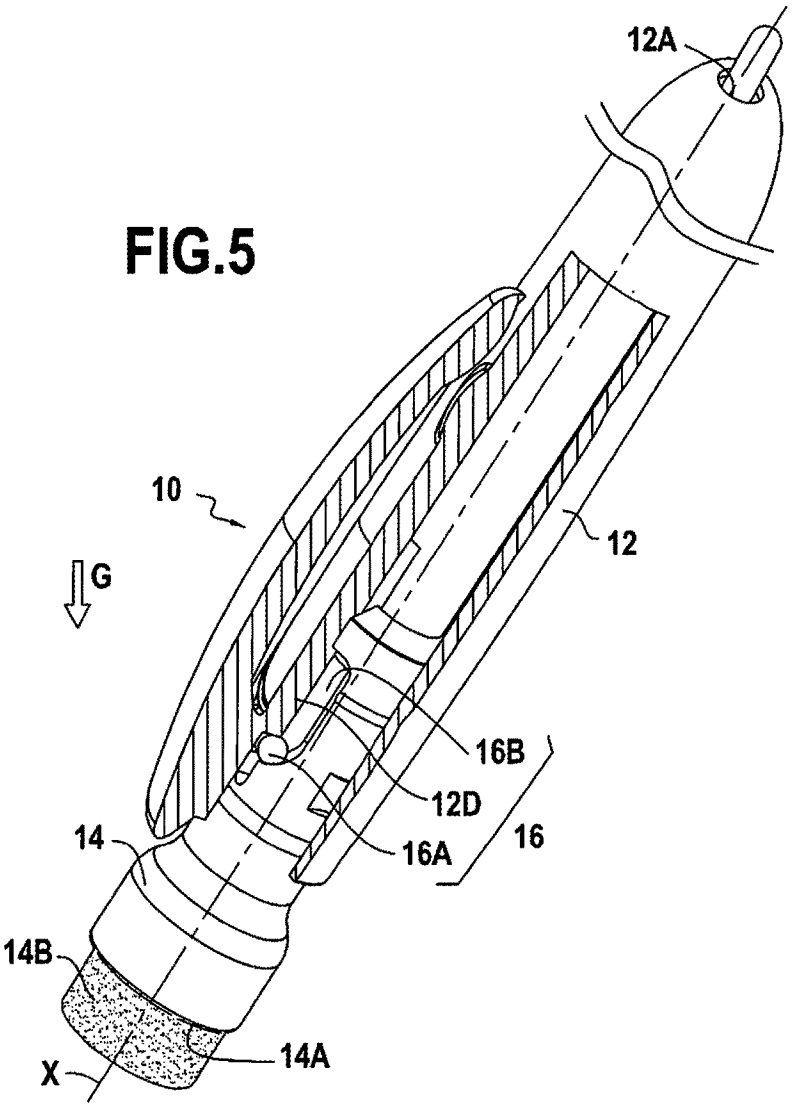
FIG. 5 is a cut-away view in which the first distal end is above the second distal end.

With reference to FIGS. 4 and 5, the abutment 12D is permanently engaged in the first passage 14D1, i.e. it is engaged regardless of the position of the first portion 12 relative to the second portion 14. This makes it possible to block turning of the first portion relative to the second portion 14 (and vice versa) about the axial direction X, whereby the abutment 12D remains permanently in alignment with the second passage 14D2. In addition, at rest, i.e. when the user is not moving the first portion 12 in the axial direction X relative to the second portion 14, the abutment 12D is not engaged in the second passage 14D2. Consequently, the inlet 14D21 of the second passage 14D2 forms a receptacle configured to receive the ball 16A in part when, considered in the gravity direction G, the first distal end 12A is above the second distal end 14A. In other words, the receptacle is formed by the second passage 14D2.

Thus, as shown in FIG. 4, when the first distal end 12A is below the second distal end 14A considered in the gravity direction G, the blocking device 16 allows relative movements in translation in the axial direction X between the first portion 12 and the second portion 14. Indeed, since the ball 16A is free to move inside the chamber 16B, in this configuration the ball 16A automatically places itself, under the effect of gravity, at the lowest point of the chamber 16B, considered in the gravity direction. In this configuration, since the lowest point of the chamber 16B is substantially opposite in the axial direction X of the second passage 14D2, the inlet 14D21 of said passage remains unobstructed. Thus, the abutment 12D is not blocked and is able to engage in the portion in the second passage 14D2, whereby the first portion 12 is movable axially relative to the second portion 14. The relative movement in axial translation of the first and second portions 12 and 14 is shown by double-headed arrow II in FIG. 4. In FIG. 4, the ball 16A is in a free position while the hand-held device 10 is in its first configuration.

With reference to FIG. 5, when the first distal end 12A is above the second distal end 14A considered in the gravity direction G, and only in this position, the blocking device 16 allows relative movements in translation in the axial direction X between the first portion 12 and the second portion 14. Indeed, in this position, under the effect of gravity, the ball 16A moves until it reaches the inlet 14D21 of the second passage 14D2, this inlet forming a receptacle for the ball 16A and being interposed between the abutment 12D and the second passage 14D2. In this configuration the inlet 14D21 forms the lowest point of the chamber 16B. Thus, the abutment 12D is blocked in axial translation by the ball 16A, whereby the relative movements in translation between the first and second portions 12 and 14 are blocked. In FIG. 5, the ball 16A is in the blocking position, whereas the hand-held device 10 is in its second configuration.

As can be seen in FIG. 4, the axial space E between the abutment 12D and the inlet 14D21, or more generally between the abutment 12D and the wall of the chamber 16B has a length that is equal to 105% of the diameter of the ball 16A, whereby the axial clearance between the first portion 12 and the second portion 14 when the ball 16A is in the blocking position is particularly small.

Since the blocking device 16 is totally independent of the lead-propelling device (not shown), blocking may naturally take place regardless of the configuration of the lead-propelling device. This is generally true regardless of the actuation mechanism of the first head 12B. By way of example, in a variant, the first head is a ballpoint or felt-tip while the mechanism is a ratchet mechanism for retracting/extending the first head into/out from the first distal end 12A. In this situation, the second head is, for example, a friction body or a pad for a capacitive screen. Naturally, any other combination of first and second heads may be envisaged.

Although the present invention is described with reference to specific embodiments, it is clear that modifications and changes may be made to these embodiments without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

The invention claimed is:

1. A hand-held device comprising a first portion and a second portion, the first portion being engaged at least in part with the second portion while being movable in translation in an axial direction relative to the second portion, the first portion presenting a first distal end while the second portion presents a second distal end opposite from the first distal end in the axial direction, and a blocking device configured to prevent the first portion from moving in translation in the axial direction relative to the second portion only when, considered in the gravity direction, the first distal end is arranged above the second distal end, the blocking device comprising a chamber and a ball housed in the chamber, a wall defining a volume of the chamber presents a receptacle configured to receive all or part of the ball when, considered in the gravity direction, the first distal end is arranged above the second distal end, the blocking device comprising an abutment configured to cooperate with the ball when, considered in the gravity direction, the first distal end is arranged above the second distal end, the receptacle being made in a wall forming part of a portion selected from the first portion and the second portion, whereas the abutment is secured to the other portion from among the first portion and the second portion.

2. A hand-held device according to claim 1, wherein the chamber is formed between two walls respectively forming parts of the first portion and of the second portion.

3. A hand-held device according to claim 1, wherein the receptacle is formed by a passage extending in the axial direction from the chamber, the passage presenting a width that is smaller than the diameter of the ball.

4. A hand-held device according to claim 3, wherein the abutment is configured to engage at least in part in the passage during the movement in translation of the first portion relative to the second portion.

5. A hand-held device according to claim 1, wherein the ball is metallic.

6. A hand-held device according to claim 1, wherein between two walls is a minimum distance that defines a cavity of the chamber that lies in the range 102% to 125% of the diameter of the ball.

7. A hand-held device according to claim 1, forming a writing instrument extending in the axial direction.

8. A hand-held device according to claim 7, wherein the first distal end is fitted with a writing tip, whereas the second distal end is fitted with an eraser, a friction body, or a pad for a capacitive screen.

* * * * *